US005591383A

United States Patent [19]

Krup

[11] Patent Number: 5,591,383

[45] Date of Patent: Jan. 7, 1997

[54] CARBURETOR AND METERING DEVICE THEREFOR

[76] Inventor: William R. Krup, 1000 Market St., Mt. Carmel, Ill. 62863

[21] Appl. No.: 477,762

[22] Filed: Jun. 7, 1995

Related U.S. Application Data

[63] Continuation-in-part of Ser. No. 428,332, Apr. 25, 1995, abandoned.

[51] Int. Cl.[6] ..... F02M 19/06

[52] U.S. Cl. ..... 261/34.1; 261/121.3

[58] Field of Search ..... 261/34.1, 121.3, 261/41.3, 44.8

[56] References Cited

U.S. PATENT DOCUMENTS

| | | | |
|---|---|---|---|
| 2,103,629 | 12/1937 | Moore | 261/121.3 |
| 3,341,185 | 9/1967 | Kennedy, Sr. | 261/41.4 |
| 3,661,367 | 5/1972 | Mennesson | 261/121.3 |
| 3,807,707 | 4/1974 | Johnson | 261/34.1 |
| 4,003,968 | 1/1977 | Rickert | 261/34.1 |
| 4,277,423 | 7/1981 | Noguez | 261/34.1 |
| 5,283,011 | 2/1994 | McClintic et al. | 261/34.1 |

OTHER PUBLICATIONS

Mike Urich & Bill Fisher, Holley Carburetor & Manifolds, 1978, pp. 22–36, 51–54, 62, 66 and 129–134.

*Primary Examiner*—Tim R. Miles

*Attorney, Agent, or Firm*— Senniger, Powers, Leavitt & Roedel

[57] ABSTRACT

A metering device for a carburetor which permits liquid fuel flow in a primary fuel supply circuit to be adjusted without disassembly of the carburetor. The adjustable metering is accomplished prior to mixture of the liquid fuel with air in the metering device. The metering device is particularly constructed to achieve short and direct paths for transport of fuel to the air stream flowing through the carburetor to the manifold. A fuel bowl side bleed permits greater atomization of the fuel to produce higher percentage burn of the fuel.

17 Claims, 5 Drawing Sheets

FIG. 10

| JET NO. | EFF. DIA. | JET NO. | EFF. DIA. | JET NO. | EFF. DIA. | JET NO. | EFF. DIA. | JET NO. | EFF. DIA. | JET NO. | EFF. DIA. |
|---|---|---|---|---|---|---|---|---|---|---|---|
| 40 | .040 | 51 | .050 | 61 | .060 | 71 | .076 | 81 | .093 | 91 | .105 |
| 41 | .041 | 52 | .052 | 62 | .061 | 72 | .079 | 82 | .093 | 92 | .105 |
| 42 | .042 | 53 | .052 | 63 | .062 | 73 | .079 | 83 | .094 | 93 | .105 |
| 43 | .043 | 54 | .053 | 64 | .064 | 74 | .081 | 84 | .099 | 94 | .108 |
| 44 | .044 | 55 | .054 | 65 | .065 | 75 | .082 | 85 | .100 | 95 | .118 |
| 45 | .045 | 56 | .055 | 66 | .066 | 76 | .084 | 86 | .101 | 96 | .118 |
| 47 | .047 | 57 | .056 | 67 | .068 | 77 | .086 | 87 | .103 | 97 | .125 |
| 48 | .048 | 58 | .057 | 68 | .069 | 78 | .089 | 88 | .104 | 98 | .125 |
| 49 | .048 | 59 | .058 | 69 | .070 | 79 | .091 | 89 | .104 | 99 | .125 |
| 50 | .049 | 60 | .060 | 70 | .073 | 80 | .093 | 90 | .104 | 100 | .128 |

357L
301L
330
307L
356L
L
352L
348L
342L
330
300L
346L
330
326
336
334
303L
350L
354L
330
368L
366L
364L
358L
328
322

322
378R
330
332
340
300R
332
395
357R
364R
370R
301R
307R
356R
342R
368R
366R
346R
390
334
330
392
326
336
394
330
357L
301L
307L
342L
368L
366L
364L
12
12
346L
378L
332
356L
370L
330
332
324
344L
338
300L

CARBURETOR AND METERING DEVICE THEREFOR

This is a continuation-in-part application of U.S. application Ser. No. 08/428,332, filed Apr. 25, 1995, now abandoned.

BACKGROUND OF THE INVENTION

The text of U.S. application Ser. No. 08/428,332 is incorporated by reference as if set forth fully herein.

This invention relates generally carburetors for internal combustion engines and more specifically to a metering device of a carburetor.

High performance as well as fuel economy of an internal combustion engine, and in particular automobile racing engines, is greatly affected by operation of the engine's carburetor. In general, the carburetor must feed the proper amount of fuel to air stream flowing into the engine, at the proper time, so that the engine runs smoothly and with the power needed, without wasting fuel or running too hot. The proper amount of fuel to be metered to the air stream will depend on several factors, including the construction of the particular engine and ambient air conditions. Generally speaking when the ambient air is cool and dry, its density increases so that more fuel is required to maintain the proper mass ratio of fuel to air in the cylinders. In contrast, warm humid ambient air conditions reduce the density of the air in the cylinder so that less fuel should be supplied. Thus, to achieve the optimum operation of the carburetor under different conditions, it is desirable to adjust the carburetor.

A typical carburetor includes a main body through which a stream of air from the air intake passes to the manifold, and in which the fuel is fed to the air stream. A fuel bowl holding a reservoir of gasoline to be fed to the air stream is mounted on the main body by a metering block through which a measured flow of fuel is aspirated from the fuel bowl to the air stream in the main body. One face of the metering block forms a wall of the fuel bowl which is usually immersed about half way up the face in the gasoline in the bowl. The metering block has an idle/transfer circuit which transfers fuel to the main body when the engine is running at low to moderate speeds, and a main circuit which transfers fuel at higher engine speeds. Some of the air received in the main body is diverted to a main air bleed in the metering block and thence to the main fuel and idle/transfer circuits for premixing with the liquid fuel from the fuel bowl prior to the introduction of the fuel to the air stream in the main body. The introduction of air facilitates the atomization of the fuel needed to produce a combustible air/fuel mixture for the engine.

Optimum performance of the engine depends in part upon the degree of atomization of the fuel which reaches the combustion chamber of the engine. The greater the mixing of air and fuel, the higher the percentage of fuel which is burned in the combustion chamber. The atomization produced by the main air bleed in the metering block and by aspiration of the liquid fuel into the air flow through the main body of carburetor, while good, still delivers a substantial amount of fuel to the combustion chamber in drops which are too large to burn.

Presently, main fuel circuits and idle/transfer circuits in metering blocks have several changes in direction within the metering block. Frequent and/or sharp changes in direction cause the fuel to flow turbulently through the metering block. It requires more energy and is more difficult to move the fuel through a tortuous path. In addition, these circuits tend to be somewhat long, causing small but measurable delays from the time when the throttle is open and the engine calls for additional fuel, and the actual delivery of fuel to the air stream in the main body.

The amount of fuel drawn from the fuel bowl depends upon the momentum of the air stream flowing through the main body and on the size of the restriction in the idle/transfer circuit and main circuit in the metering block. The restriction is achieved by insertion of a metering jet into the circuit in the metering block. Most commonly, the metering jets for the main circuit are placed in the intake port for the main circuit on the first face of the metering block in the fuel bowl. The metering jets can be changed, but require disassembly of the fuel bowl and metering block from the main body to do so. Thus, for example, it would be completely impractical to adjust the metering of the main circuit during the course of a race, and very difficult to make rapid alterations when testing an engine on a dynamometer.

There are presently existing metering blocks which permit an adjustment of the air/fuel ratio in the air stream in the carburetor without disassembly of the fuel bowl and metering block from the main body. The Total Control Metering System metering block made by Racing Engine Components of Colorado Springs, Colo. has a single air/fuel ratio adjuster which can be manipulated while the metering block and fuel bowl are mounted on the main body. The air/fuel ratio adjuster includes metering portions which are disposed in both main fuel circuits of the metering block downstream of the location where air is introduced to the fuel from the main air bleed. A wide range of flow rates is permitted. An actuator portion of the adjuster extends from the metering portion to a location outside an end wall of the metering block where it is accessible for adjustment without disassembly of the carburetor. The metering portion is shaped so that by turning the adjuster on its longitudinal axis within the metering block, the effective cross sectional areas of both main fuel circuits are changed in the same way to change the fuel/air ratio.

Changing both main fuel supply circuits in the metering blocks limits the precision of the adjustment. In many cases, the optimal allocation to each cylinder of fuel fed through a single metering block is not the same for each cylinder. In addition, permitting a wide range of change in the flow rates of fuel increases the chance that an engine might be damaged as a result of an improper fuel flow setting for a particular engine under certain ambient conditions.

Adjusting the fuel flow to the main body through use of an air/fuel ratio adjuster which meters the flow of an air/fuel mixture has certain problems. Substantially more fuel enters the metering block and flows past the location where air is introduced to the fuel than will ultimately be metered to the air stream in the carburetor. Thus, less air is mixed with the fuel in the metering block. The flow of the air/fuel mixture through the restriction caused by the metering portion of the adjuster tends to become irregular. Moreover, the restriction tends to separate the fuel from the air so that the advantage of pre-mixing the fuel with air in the metering device prior to introduction into the air stream in the main body, is lost to a significant degree. Thus, it is possible for the fuel to be insufficiently atomized when it enters the air stream, adversely affecting combustion in the engine.

SUMMARY OF THE INVENTION

Among the several objects and features of the present invention may be noted the provision of a carburetor metering device which permits adjustment of the fuel flow into the air stream in the carburetor without disassembly of the carburetor; the provision of such a metering device which precisely controls the amount of fuel metered; the provision of such a metering device which increases the percentage of fuel burned by the engine; the provision of such a metering device which thoroughly mixes the fuel with air to produce a fine mist; the provision of such a metering device which inhibits the fuel mixture from becoming too lean; the provision of such a metering device which permits adjustment of the fuel flow without interrupting the uniformity of the flow; the provision of such a metering device which permits adjustment of the fuel flow without separation of fuel and air mixed in the metering device; the provision of such a metering device which delivers fuel rapidly to the air stream in the carburetor; the provision of such a metering device which permits fuel fed through the metering device to different cylinders to be metered at different flow rates; the provision of such a metering device which minimizes fuel turbulence; the provision of such a metering device which delivers fuel along short direct paths to the air stream; and the provision of such a metering device which is easy to manufacture and simple to use.

Further among the several objects and features of the present invention may be noted the provision of a carburetor having the aforementioned metering device.

Generally, a liquid fuel metering device constructed according to the principles of the present invention comprises a block having a first face adapted for engagement with a liquid fuel reservoir and a second face adapted for engagement with a main body of a carburetor. A primary fuel supply path includes a primary intake port in the first face of the block for intake of liquid fuel from the liquid fuel reservoir, a primary exit port in the second face of the block through which fuel may pass into the main body, and a primary passage extending from the primary intake port to the primary exit port for transport of fuel from the primary intake port to the primary exit port. A main air bleed associated with the block and constructed for receiving air includes means for delivery of air from the main air bleed to the primary passage for mixing air with fuel in the primary passage. The air delivery means comprises at least one conduit which extends between the main air bleed and the primary passage, the one conduit opening into the primary passage at a first location which is the location nearest to the primary intake port where air is introduced to the primary passage. Adjustable fuel flow control means adjusts the effective cross sectional area of the primary passage at a second location between the first location where air is introduced into the primary passage and the primary intake, thereby to selectively alter the flow of fuel through the primary passage. The block and the adjustable fuel flow control means are constructed and arranged for adjusting the flow of fuel through the metering device from a location exterior to the block when the first and second faces of the block are engaged with the fuel reservoir and the main body, respectively.

In another aspect of the present invention, a metering device including a block and a primary fuel supply path substantially as described above. The metering device further includes an idle fuel supply path including an idle intake port in the first face of the block of the metering device for intake of liquid fuel from the liquid fuel reservoir, an idle exit port in the second face of the block through which fuel may pass into the main body, and an idle passage extending from the idle intake port to the idle exit port for transport of fuel from the idle intake port to the idle exit port. The idle passage lies generally in a plane perpendicular to the first and second faces of the block.

In still another aspect of the present invention, a metering device including a block and primary fuel supply path as described above. The primary passage of the primary fuel supply path lies generally in a plane perpendicular to the first and second faces of the block.

In a further aspect of the present invention, a metering device including a block and primary fuel supply path as described above. A fuel bowl side air bleed is provided to introduce air into the fuel into the primary fuel supply path from an opening on the face of the block which is adapted to engage the fuel bowl.

Other objects and features of the present invention will be in part apparent and in part pointed out hereinafter.

BRIEF DESCIRPTION OF THE DRAWINGS

FIG. 10 is a chart showing the relationship between a jet number and a restricted effective diameter of a primary passage in the metering device;

Corresponding reference characters indicate corresponding parts throughout the several views of the drawings.

DETAILED DESCRIPTION OF THE PREFERRED EMBODIMENTS

Figure 1:
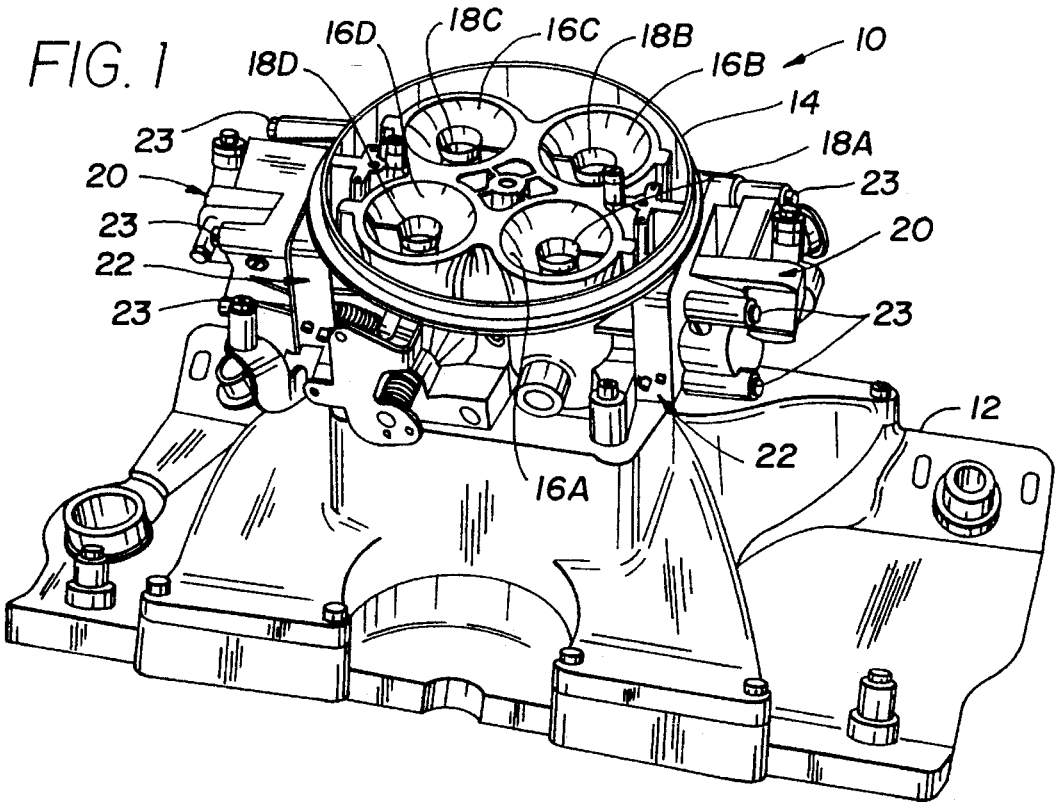
FIG. 1 is a perspective of a carburetor on an engine manifold.

Referring now to the drawings, and in particular to FIG. 1, a four barrel carburetor (indicated generally at 10) of the present invention is shown as mounted on the manifold 12 of an engine, with an air intake and choke of the engine removed so that details of the carburetor construction can be seen. The carburetor 10 includes a main body 14 defining four barrels (designated 16A–16D, respectively) through which air is conducted from the air intake and where gasoline is mixed with the air. Each barrel services two cylinders (not shown) of the engine. Booster venturis (designated 18A–18D) are mounted within each barrel 16A–16D to provide a greater vacuum for aspiration of fuel through a primary fuel supply circuit, to be described more fully below. A fuel bowl and metering device (indicated generally at 20 and 22, respectively) are mounted on the front side of the main body 14 by bolts 23 received through the fuel bowl and metering device. Another fuel bowl 20 and metering device 22 are mounted on the backside of the main body 14 by the bolts 23. The metering devices 22 are substantially identical in the preferred embodiment, so that a description of one of the metering devices suffices for both. The fuel bowls 20 (broadly, "fuel reservoirs") hold a quantity of liquid fuel which is metered through the metering devices 22 to the main body 14 of the carburetor. The construction and operation of the carburetor 10, except for the metering device 22, is well known to those of skill in the art, being substantially identical to a Holly 4150 carburetor available from Holly Carburetor Division of Coltec Industries of Bowling Green, Ky. Thus, the details of construction of the parts of the carburetor 10 other than the metering device 22 will be omitted. However, it is to be understood that the metering block 22 of the present invention may be used in other carburetors and still fall within the scope of the present invention.

Figure 2:
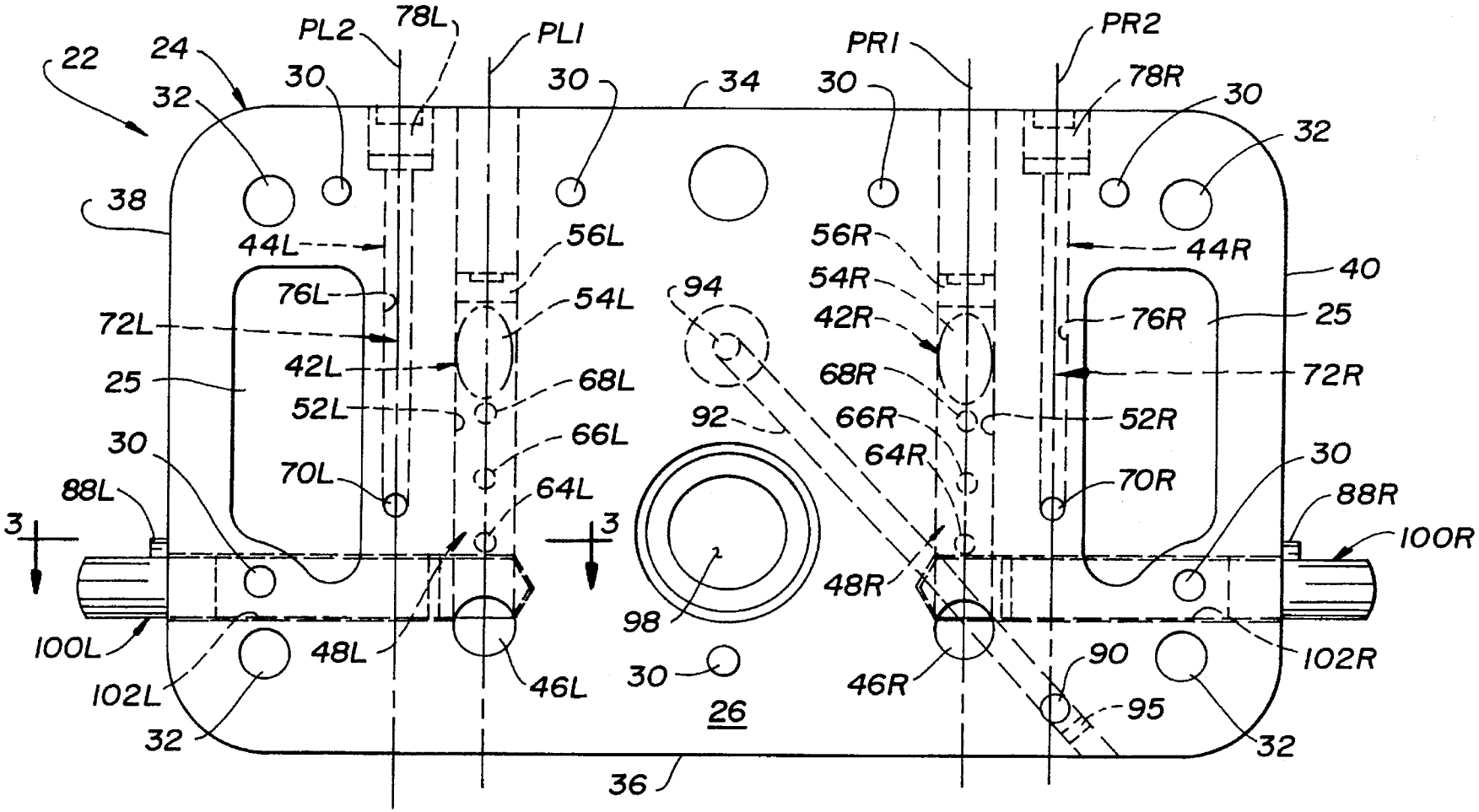
FIG. 2 is a front elevation of a metering device of the present invention.
Figure 5:
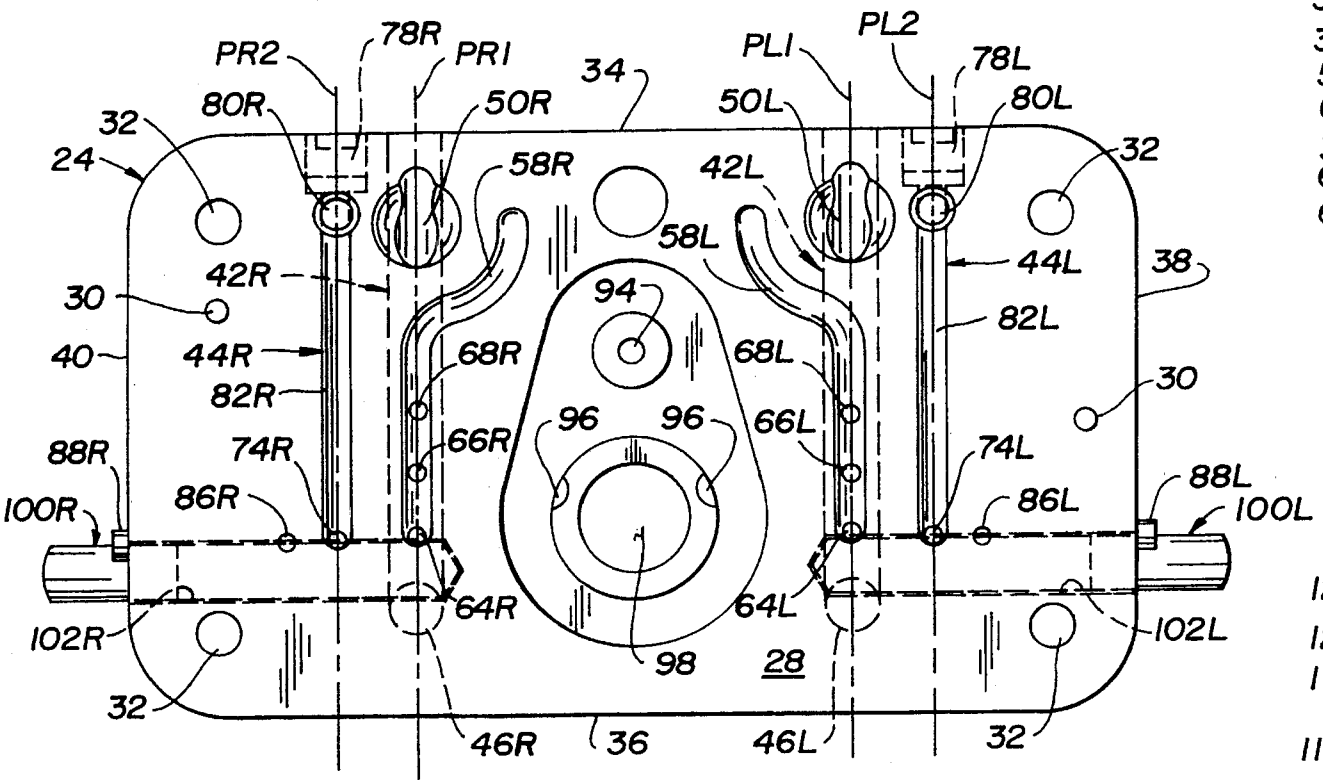
FIG. 5 is a rear elevation of the metering device.

Referring now to FIGS. 2 and 5, the metering device 22 is shown to comprise a block, generally indicated at 24, which has been machined from solid aluminum. Recesses 25 have been cut into the block to reduce weight. It is to be understood that the block 24 may be formed in other ways, such as by casting, and from other materials and still fall within the scope of the present invention. The block 24 has a first face 26 (FIG. 2) adapted for engagement with the fuel bowl 20 and a second face 28 (FIG. 5) adapted for engagement with the main body 14. Proper registration with the main body 14 and the fuel bowl 20 is achieved by dowels 30 projecting outwardly from both faces 26, 28 of the block 24, and capable of reception in corresponding holes (not shown) in the main body and fuel bowl. Apertures 32 near the corners of the block 24 receive the bolts 23 connecting the metering device 22 and fuel bowl 20 to the main body 14. Peripheral wall means of the block 24 constitutes in the preferred embodiment top and bottom side walls (designated 34 and 36, respectively), and opposite end walls (designated 38 and 40, respectively) extending between the first and second faces 26, 28 of the block.

As shown in FIG. 2, the block 24 has been formed with a left and right primary fuel supply paths (indicated generally at 42L and 42R, respectively), and a left and right idle/transfer paths (indicated generally at 44L and 44R, respectively). The primary fuel supply path and idle/transfer paths on each end of the block 24 serve a respective one of the barrels 16A–16D of the carburetor 10. The components of the metering device 22 which are duplicated on the left and right ends of the block 24 will be designated by the same reference numeral, followed by an "L" or an "R" depending upon which end of the block the component may be found as viewed in FIG. 2. Only the construction of the left end components of the metering device 22 will be described, the construction of the right end components being identical. The primary fuel supply path 42L and the idle/transfer path 44L form a part of the primary fuel supply circuit and the idle/transfer circuit, respectively. The remaining portions of these circuits are formed in the main body 14 of the carburetor 10 and are of conventional construction.

The primary fuel supply path 42L includes a primary intake port 46L located relatively low on the first face 26 of the block 24 so that the primary intake port is always covered by fuel in the fuel bowl 20 when the metering device 22 is engaged with the fuel bowl. A primary passage, generally indicated at 48L, extends from the primary intake port 46L to a primary exit port 50L on the second face 28 of the block 24 (FIG. 5) which communicates with an intake port (not shown) on the main body 14 of the carburetor 10. Ultimately, the fuel travelling through the primary fuel supply circuit reaches the booster venturi 18A in the barrel 16A where it is discharged to the air stream flowing through the booster venturi to the manifold 12.

The primary passage 48L includes a first segment 52L extending generally vertically upward from the primary intake port 46L and a second segment 54L intersecting the first segment. The second segment 54L extends at an angled which is skew to the first and second faces 26, 28 of the block 24, upward and toward the second face to the primary exit port 50L. In the preferred embodiment, the second segment 54L makes an angle of about 151° with the first segment 52L so that the fuel makes a gradual turn toward the primary exit port 50L. The first segment 52L is formed by a hole drilled from the Lop side wall 34 of the block 24 down to the primary intake port 46L. The hole is counterbored to a location just above the intersection of the hole with the second segment 54L of the primary passage 48L and a plug 56L positioned at that location blocks the passage of fluid in the hole past the plug. The first segment 52L constitutes that portion of the hole between the primary intake port 46L and the plug 56L. The centerlines of the first and second segments 52L, 54L of the primary passage lie in a plane PL1 which is perpendicular to the first and second faces 26, 28 of the block. In this way, the flow path of fuel through the metering device 22 is short and has a minimal number of turns from the primary intake port 46L to the primary exit port 50L.

Figure 6:
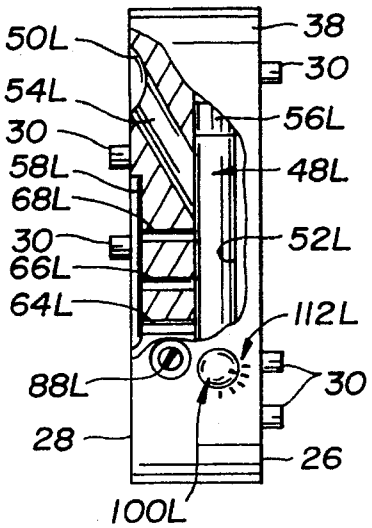
FIG. 6 is a left side elevation of the metering device with parts broken away to show a primary fuel supply path within the block.

As shown in FIG. 5, a main air bleed comprises a groove 58L in the second face 28 of the block 24 including a curved upper section and a straight lower section. As seen in FIG. 5, the groove 58L is open, but when the second face 28 of the block is engaged with the main body 14 of the carburetor 10, a flat face (not shown) of the main body closes the groove except at the top of its curved upper section. A port (not shown) in the main body 14 aligned with the groove 58L at the top of the upper section transmits bleed air from one of the barrels 16A to the groove. The air travels down the groove 58L to three conduits (designated 64L, 66L and 68L) bored inwardly from the second face 28 of the block to the first segment 52L of the primary passage 48L (FIG. 6). The air from the groove 58L is mixed with the liquid fuel travelling up the primary passage 48L within the metering device 22.

Figure 3:
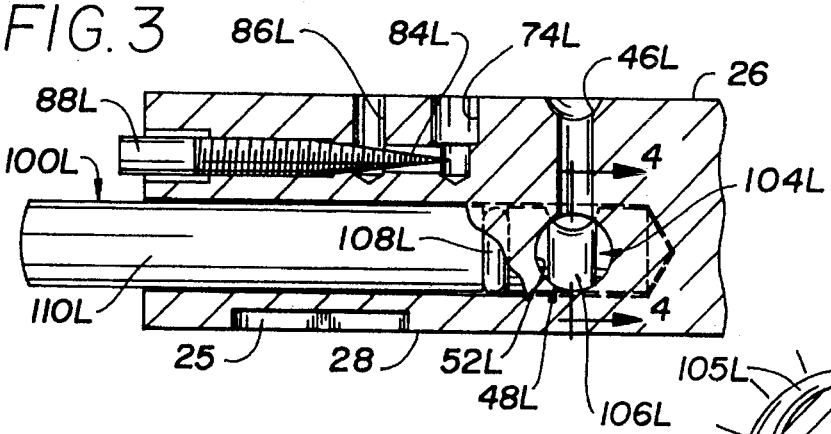
FIG. 3 is a fragmentary section taken in the plane including line 3—3 of FIG. 2 with parts broken away to reveal an adjustable metering rod and a primary intake port.
Figure 7:
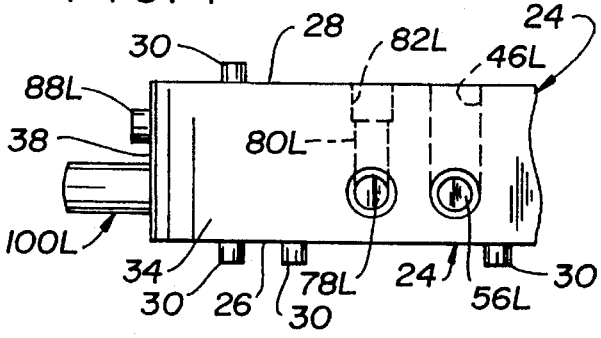
FIG. 7 is a fragmentary, left top side plan of the metering device.

The idle/transfer fuel path 44L has an idle/transfer intake port 70L in the first face 26 of the block 24 communicating with an idle/transfer passage, generally indicated at 72L, leading to an idle exit port 74L on the second face 28 of the block. Like the primary passage 48L, the centerline of the idle/transfer passage 74L lies generally in a plane PL2 which is perpendicular to the first and second faces 26, 28 of the block. A first portion 76L of the idle/transfer passage 72L extends within the block 24 from a the idle/transfer intake port 70L to a location near the top side wall 34 of the block (FIG. 2). The first portion 76L is formed by a hole bored from the top side wall 34 of the block 24 and shut off by a plug 78L received in the hole. The idle/transfer passage 72L has a crossover portion 80L (FIG. 7) extending from the upper end of the first portion 76L of the passage into a channel 82L formed in the second face 28 of the block (FIG. 5). The channel 82L extends down the second face 28 of the block to the idle exit port 74L, which communicates via a lateral passage 84L with a transfer port 86L (FIG. 3). Although the channel 82L is open as seen in FIG. 5, the channel is closed by engagement with the flat face of the main body 14 so that fuel flows within the channel until it reaches the exit and transfer ports 74L, 86L. The top of the channel 82L communicates with a bleed air port (not shown) in the face of the main body 14 which introduces air to the fuel flow in the idle/transfer fuel supply path 44L.

As shown in FIG. 3, the lateral passage 84L receives the tapered end of a set screw 88L which controls the flow of the fuel/air mixture in the idle/transfer fuel supply path 44L through the lateral passage 84L and out of the transfer port 86L. The set screw 88L extends out through the end wall 38 of the block 24 where is accessible for manipulation. The idle exit port 74L communicates with an opening (not shown) in one of the barrels 16A of the carburetor which is just below the throttle (not shown). Thus, when the throttle is only very slightly opened, the vacuum pressure in the manifold 12 of the engine is communicated through the idle/transfer circuit to the idle exit port 74L in the block, and fuel is fed to the engine through the idle exit port. However, when the throttle opens slightly more to run the engine at low speeds, another opening in the barrel (also not shown) is exposed to the manifold vacuum and fuel is also drawn through the transfer port 86L in the block.

Fuel is delivered through the main fuel supply path 48L only when the throttle is opened sufficiently to develop the vacuum necessary to draw the fuel through the booster venturi 18A. Fuel needed for rapid acceleration of the engine can be provided through an acceleration fuel circuit including an acceleration fuel supply path within the block. As shown in FIG. 2, the acceleration fuel supply path includes an acceleration intake port 90 in the first face 26 of the block 24 which extends inwardly toward the second face 28 where it communicates with an acceleration passage 92 extending at an angle to an acceleration exit port 94 in the second face of the block. The acceleration passage 92 (shown in hidden lines in FIG. 2, but not shown in FIG. 5 for clarity in illustration of the features of the present invention) is formed by drilling a hold from the bottom side wall 36 which intersects the acceleration intake port 90 and acceleration exit port 94. A plug 95 is placed in the hole below the acceleration intake port 90. A pump (not shown) in the fuel bowl 20 is operable when rapid acceleration is detected to force fuel into the acceleration intake port 90 for delivery to both barrels 16A, 16B on the side of the main body 14 associated with that particular metering device 22. When there is a sustained requirement for additional power, a power valve (not shown, but of conventional construction) is opened permitting fuel to pass into orifices 96 located in a central opening 98 in the block 24. In ordinary operation, the power valve closes the central opening 98 so that no fuel may flow into the orifices 96. The power valve is held shut by exposure of the valve to the vacuum on the manifold 12, which overcomes the force of a spring on the valve. However when the engine is running at high speeds, the vacuum on the valve drops sufficiently that the spring causes the valve to open, admitting the additional fuel to the orifices 96. The general operation of the carburetor 10 described in this paragraph is standard for the type of carburetor disclosed in the preferred embodiment. Thus, the operation is described only generally, the details being well understood by those of ordinary skill in the art.

Figure 4:
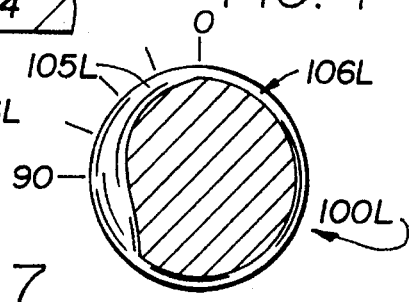
FIG. 4 is a section of the adjustable metering rod taken in the plane including line 4—4 of FIG. 3.

As may be seen in FIGS. 2 and 5, the metering device 22 of the present invention has unique adjustable liquid fuel flow control means for the primary fuel supply path 48L in the block 24 in the form of a cylindrical metering rod, generally indicated at 100L, received in a flow control hole 102L extending inwardly from an end wall 38 of the block. Referring to FIGS. 3 and 4, each rod 100L includes a metering portion, indicated generally at 104L, disposed in the primary passage 48L at a (second) location between the primary intake port and the (first) location where the first conduit 64L from the main air bleed intersects the primary passage. Thus, the metering rod 101L meters liquid fuel prior to its mixture with air and does not interfere with the flow or emulsification of the fuel/air mixture.

The metering portion 104L of the metering rod 100L intersects the primary intake port 46L so that fuel entering the intake port flows around the curved surface of the metering rod as it enters the first segment 52L of the primary passage 48L. The metering rod 100L not only serves to meter the flow of fuel into the primary passage 48L but reduces turbulence in the fuel as it turns from a generally horizontal direction in the primary intake port 46L to a generally vertical direction in the first segment 52L of the primary passage. The curvature of the metering rod 100L effectively puts a radius on the turn from the primary intake port 46L to the primary passage 48L, making the turn more gentle.

As may be seen in FIG. 4, the metering portion 104L comprises in a first embodiment a generally circumferentially extending cutout of non-uniform size, generally indicated at 106L. In the first embodiment, the cutout 106L is formed by first making a groove of uniform depth and width extending around the entire circumference of the rod 100L. The presence of this groove prevents the flow of fuel from ever being shut off by operation of the rod 100L. A second cut of non-uniform depth is made along a portion of the groove so that the depth a section 105L of the cutout 106L between the 0° and 90° positions indicated on FIG. 4, gradually increases in depth. The shape of the metering portion 104L permits it to vary the effective cross sectional area of the primary passage 48L in which it is disposed as the metering rod 100L is turned about its longitudinal axis. The deeper the portion of the section 105L of the cutout 106L which is aligned with the primary passage 48L, the greater the mass flow rate of fuel past the metering portion 104L. However, it is to be understood that the size of the cutout may also be varied by changing its width, or a combination of width and depth and still fall within the scope of this invention.

Preferably, the increase in depth of the cutout 106L in section 105L is such that the change in effective orifice size of the primary passage 48L can be varied by approximately five jet numbers, in one jet number increments. The correspondence between jet numbers and the approximate effective diameter of the primary passage 48L are shown in the chart in FIG. 10, and is generally well understood by those of ordinary skill in the art. Of course, the relationship between the effective diameter of the primary passage 48L and its effective cross sectional area is understood to be the relationship between the area of a circle and its diameter. Limitation of the range over which the metering device 22 can be adjusted helps to prevent damage to the engine by incorrect adjustment of the metering rod 100L. An O-ring 108L held in a circumferential channel adjacent to the metering portion 104L engages the flow control hole 102L and seals it against the passage of fuel out of the primary passage 48L. The O-ring 108L permits the metering rod 100L to be turned on its longitudinal axis without breaking its seal with the flow control hole 102L.

An actuator portion 110L of the metering rod 100L extends laterally outwardly from the metering portion 104L to a location outside the end wall 38 of the block 24 where it can be manipulated while the metering device 22 and fuel bowl 20 are mounted on the main body 14 of the carburetor 10. Thus, adjustments to fuel flow in the primary fuel supply path 42L can be made instantly by turning the actuator portion 110L of the metering rod 100L where it extends outside of the block 24. Markings, generally indicated at 112L, are provided on the end wall 38 and on the metering rod 100L so that the desired setting for the metering rod can be quickly and accurately reached (FIG. 6).

Figure 8:
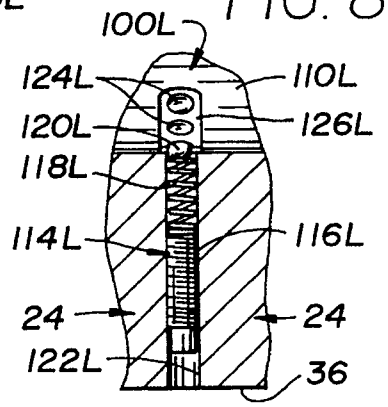
FIG. 8 is an enlarged fragmentary section of the block showing a detent mechanism for positioning the adjustable metering rod.

A detent mechanism, generally indicated at 114L in FIG. 8, permits each of five settings for the metering rod 100L between the 0° and 90° positions to be precisely and securely set. The detent mechanism 114L includes a screw 116L, a spring 118L carried by the screw and a ball 120L, which are received in a threaded hole 122L in the bottom wall 26 of the block 24. The ball 120L may be received in any one of five spaced apart recesses 124L (only two are shown) located at the bottom of a channel 126L formed on the actuator portion 110L of the metering rod 100L. The five recesses 124L each corresponding to one of the markings 112L on the block 24. The force of the spring 118L holds the ball 120L in one of the recesses 124L so that the metering rod 100L is securely held in the selected position. Torque applied manually to the metering rod 100L overcomes the spring force permitting the rod to be turned to bring a different recess 124L into registration with the detent mechanism 114L so that a different flow rate setting is achieved. However, the size of the channel 126L and stiffness of the spring 118L are selected such that it is very difficult to apply enough torque to the rod 100L to force the ball 120L out of the channel.

Figure 9:
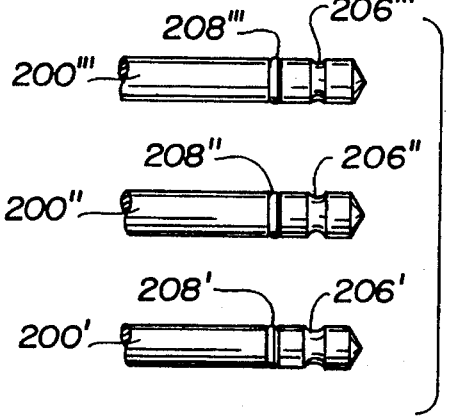
FIG. 9 is an elevation of three metering rods of a second embodiment of the present invention.

In a second embodiment of the present invention is illustrated in FIG. 9 in which a plurality of metering rods (designated 200', 200" and 200'") are provided, each having a groove (206', 206", 206'") extending around its full circumference at a constant width and depth. Adjustment of the flow of liquid fuel through the primary passage 42L is achieved by pulling out one of the metering rods 200 and replacing it with another rod having a groove 206 which is larger or smaller than the groove in the prior metering rod. The size is the groove 206 is controlled by both its width and depth in the preferred embodiment. O-rings (208', 208", 208'") mounted on the rods 200 slidingly seal with the flow control hole 102L. It is to be understood that other types of adjustable metering means may be employed while still falling within the scope of the present invention. For instance, an automatic valve (not shown) operable from a remote location could be used.

Figure 12:
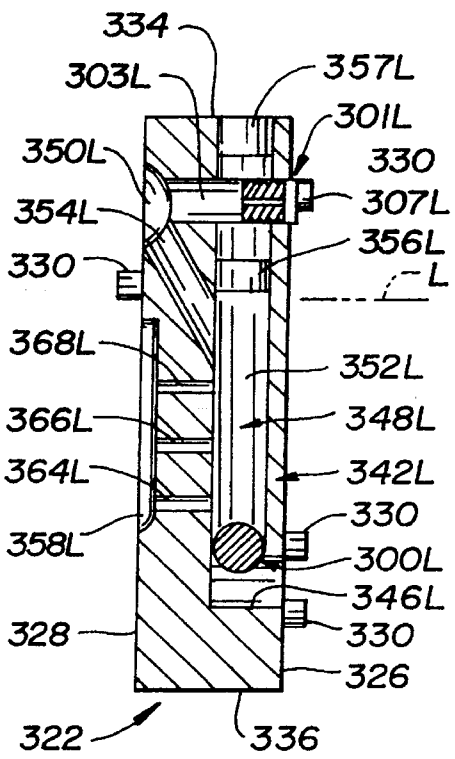
FIG. 12 is a fragmentary section taken in plane 11—11 of FIG. 11.
Figure 11:
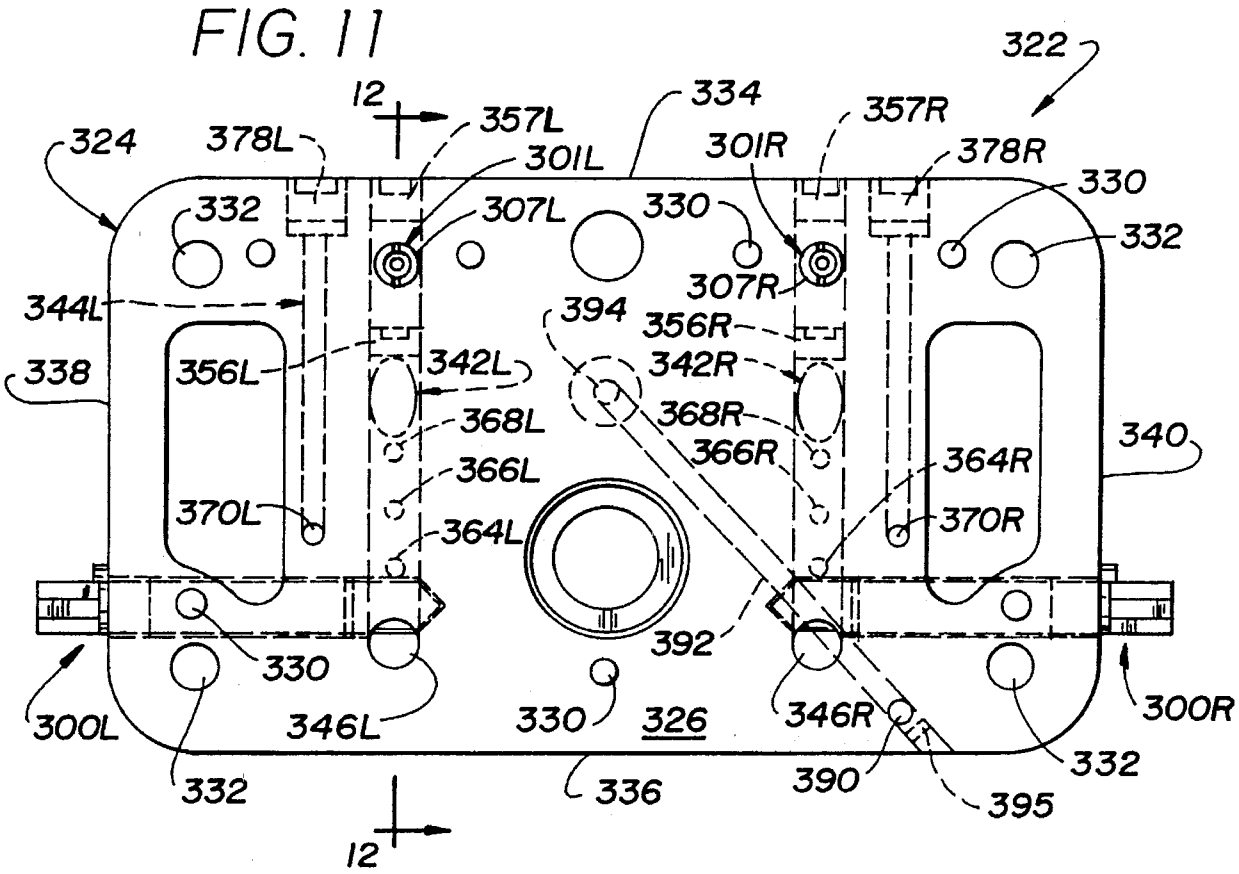
FIG. 11 is a front elevation of a metering device of a third embodiment of the present invention with a fuel bowl side air bleed.

A metering device of a third embodiment (indicated generally at 322) is shown in FIGS. 11 and 12. The parts of the metering device corresponding to those of the metering device of the first embodiment will be indicated by the same reference numerals with the addition of the prefix "3". The description of these corresponding parts will not be repeated for the metering device of the third embodiment. However, it will be noted that metering rod 300L has been modified from the first embodiment to have a hexagonal head sized for reception in the socket of an allen head screwdriver (not shown).

The metering device 322 of the third embodiment differs from the metering device 22 of the first embodiment in that it has a fuel bowl side air bleed, generally indicated at 301L. Only the air bleed 301L on the left side of the metering device 322 (as it is oriented in FIG. 11) will be described, the right side air bleed 301R being of the same construction. The air bleed 301L comprises an opening 303L in the first face 326 which extends inwardly into intersection with the primary exit port 350L of the primary fuel supply path 342L. The opening 303L is generally co-axial with the primary exit port 350L. As shown in FIG. 12, the opening 303L is located above the level of fuel in the fuel bowl 20 (indicated by phantom line L), so that air and fuel vapor above the liquid fuel in the bowl are drawn into the opening 303L.

The opening 303L also intersects the hole drilled from the top wall 334 of the block 324 to form the first segment 352L of the primary passage 348L. Like the metering block 24 of the first embodiment, the hole in the block 324 of the second embodiment has a first plug 356L located adjacent to the intersection of the first segment with the second segment 354L of the primary passage. A second plug 357L is mounted in the hole at a location nearer the top wall 334 than the intersection of the opening 303L with the hole. Thus, fuel and air can reach the exit port 350L only by way of the primary fuel supply path 342L and the fuel side air bleed 301L.

A metering jet 307L is threadably received in the opening 303L on the first face side of the metering block 324. In a preferred embodiment, the metering jet 307L is 0.035 inch in diameter. However, metering jets of other sizes may be used without departing from the scope of the present invention. The fuel bowl side air bleed 301L permits additional air to be mixed with the fuel, producing additional atomization of the fuel. Thus when the fuel passes out of the booster venturi 18A into the air flow in the main body 14, it is in the form of a very fine mist. As a result, a higher percentage of fuel is burned.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A liquid fuel metering device for use between a liquid fuel reservoir and a main body of a carburetor to meter the fuel delivered to the main body from the fuel reservoir, the metering device comprising:

a block having a first face adapted for engagement with the fuel reservoir and a second face adapted for engagement with the main body;

a primary fuel supply path including a primary intake port in the first face of the block for intake of liquid fuel from the fuel reservoir, a primary exit port in the second face of the block through which fuel may pass into the main body, and a primary passage extending from the primary intake port to the primary exit port for transport of fuel from the primary intake port to the primary exit port;

a main air bleed associated with the block and constructed for receiving air, the main air bleed including means for delivery of air from the main air bleed to the primary passage for mixing air with fuel in the primary passage, said air delivery means comprising at least one conduit which extends between the main air bleed and the primary passage, said one conduit opening into the primary passage at a first location which is the location nearest to the primary intake port where air is introduced to the primary passage;

adjustable fuel flow control means for adjusting the effective cross sectional area of the primary passage at a second location between the first location where air is introduced into the primary passage and the primary intake thereby to selectively alter the flow of fuel through the primary passage, the block and said adjustable fuel flow control means being constructed and arranged for adjusting the flow of fuel through the metering device from a location exterior to the block when the first and second faces of the block are engaged with the fuel reservoir and the main body, respectively, said adjustable fuel flow control means comprising a rod received in the block and having a metering portion disposed in the primary passage at said second location, the rod being pivotable about its longitudinal axis between multiple discrete metering positions for adjusting the cross sectional area of the primary passage at said second location thereby to change the flow of fuel through the primary passage, each metering position corresponding to a predetermined jet number; and a detent mechanism for selectively holding the rod from pivoting about is longitudinal axis in a selected one of the multiple metering positions thereby to securely fix the rod in a selected one of the multiple metering positions, the detent mechanism comprising a detent movable with respect to the rod and block in directions non-parallel to the longitudinal axis of the rod for fixing and releasing the rod in the selected metering position.

2. A liquid fuel metering device as set forth in claim 1 wherein the block has peripheral wall means extending between the first and second faces of the block, and wherein the metering device further comprises a flow control hole extending inwardly into the block from said peripheral wall means and intersecting with the primary passage at the second location, and wherein the rod is sealingly received in the flow control hole and pivotable about its longitudinal axis within the flow control hole, the rod having an actuator portion extending from the metering portion to an adjusting location outside of the block, the block having markings on said peripheral wall means adjacent the flow control hole, there being one marking for each of the multiple metering positions, each marking corresponding to a particular jet number setting, the actuator portion of the rod having a mark thereon for alignment with any one of the metering position markings by pivoting the rod about its longitudinal axis for selecting a particular jet number setting.

3. A liquid fuel metering device as set forth in claim 1 wherein the metering portion of the rod is shaped to reduce turbulence in the fuel as it changes direction from the primary intake port to the primary passage.

4. A liquid fuel metering device as set forth in claim 3 further comprising an idle fuel supply path including an idle intake port in the first face of the block for intake of liquid fuel from the fuel reservoir, an idle exit port in the second face of the block through which fuel may pass into the main body, and a idle passage extending from the idle intake port to the idle exit port for transport of fuel from the idle intake port to the idle exit port, the idle passage lying generally in a plane perpendicular to the first and second faces of the block.

5. The metering device as set forth in claim 3 in combination with the carburetor.

6. A liquid fuel metering device as set forth in claim 3 wherein the rod comprises an actuator portion extending from the metering portion to an adjusting location outside of the block.

7. A liquid fuel metering device as set forth in claim 6 wherein the metering portion of the rod is constructed such that at least a leakage flow is permitted to pass through the primary passage without regard to the position of the metering portion relative to the primary passage, the metering portion being further constructed to permit the maximum variation in the effective cross sectional area of the primary passage to be ten or fewer jet numbers.

8. A liquid fuel metering device as set forth in claim 6 wherein the block has peripheral wall means extending between the first and second faces of the block, and wherein the metering device further comprises a flow control hole extending inwardly into the block from said peripheral wall means and intersecting with the primary passage at the second location, the rod being sealingly received in the flow control hole and pivotable about its longitudinal axis within the flow control hole, the metering portion of the rod comprising a generally circumferentially extending cutout in the rod of non-uniform size whereby variation in the effective cross sectional area of the primary passage may be achieved by turning the rod about its longitudinal axis in the flow control hole to align portions of the cutout of different sizes with the primary passage.

9. A liquid fuel metering device as set forth in claim 3 wherein the primary passage lies in a plane generally perpendicular to the first and second faces of the block.

10. A liquid fuel metering device as set forth in claim 9 wherein the primary passage comprises a first segment extending generally from the primary intake port in a direction parallel to the first face of the block and a second segment intersecting the first segment and extending from the first segment toward the primary exit port at an angle to the first and second faces of the block, the first segment of the primary passage terminating at its intersection with the second segment of the primary passage.

11. A liquid fuel metering device as set forth in claim 10 wherein the block has peripheral wall means extending between the first and second faces of the block, the block having a hole therein extending from said peripheral wall means to a location generally adjacent to the primary intake port and intersecting the second segment of the primary passage, and wherein the metering device further comprises a plug in the hole located adjacent to the intersection with the second segment of the primary passage and blocking passage of fuel from the plug to the end of the hole at said peripheral wall means, the portion of the hole between the plug and the primary intake port defining the first segment of the primary passage.

12. A liquid fuel metering device as set forth in claim 1 wherein the rod is formed with plural recesses located at angularly spaced positions along the circumference of the rod, each recess being sized to receive the detent of the detent mechanism for locking the rod in a selected one of the metering positions corresponding to a particular jet number setting.

13. A liquid fuel metering device as set forth in claim 12 wherein the detent mechanism is constructed to resiliently bias the detent into engagement with the rod.

14. A liquid fuel metering device as set forth in claim 13 wherein the detent mechanism comprises a spring disposed in a compressed configuration within the block, and a ball at one end of the spring, the spring being adapted to bias the ball into one of the recesses of the rod.

15. A liquid fuel metering device as set forth in claim 1 further comprising a fuel reservoir side air bleed comprising an opening in the first face of the block extending from the first face inwardly into intersection with the primary fuel supply path, the opening being located such that it is above the level of fuel in the fuel reservoir when the first face of the block is engaged with the fuel reservoir.

16. A liquid fuel metering device as set forth in claim 15 wherein the opening is generally co-axial with the exit port of the primary fuel supply path.

17. A liquid fuel metering device as set forth in claim 16 further comprising a metering jet removably received in the opening to regulate the amount of air bled to the primary passage through the fuel bowl side air bleed.

* * * * *